United States Patent [19]

Morris, Jr.

[11] Patent Number: 4,982,574

[45] Date of Patent: Jan. 8, 1991

[54] REVERSE CYCLE TYPE REFRIGERATION SYSTEM WITH WATER COOLED CONDENSER AND ECONOMIZER FEATURE

[76] Inventor: William F. Morris, Jr., P.O. Box 1046, Raleigh, N.C. 27602-1046

[21] Appl. No.: 497,303

[22] Filed: Mar. 22, 1990

[51] Int. Cl.[5] ..... F25C 5/10

[52] U.S. Cl. ..... 62/155; 62/183; 62/233

[58] Field of Search ..... 62/155, 183, 233, 234, 62/352, 506

[56] References Cited

U.S. PATENT DOCUMENTS 3,280,585 10/1966 Lowe ..... 62/342 X
3,305,001 2/1967 Haufler et al. ..... 66/183 X
3,961,494 6/1976 Schaefer et al. ..... 62/352 X
4,338,794 7/1982 Haasis, Jr. ..... 62/506 X
4,357,807 11/1982 Aleksandrow ..... 62/233 X
4,487,032 12/1984 Speicher ..... 62/183

*Primary Examiner*—William E. Tapolcal
*Attorney, Agent, or Firm*—Mason, Fenwick & Lawrence

[57] ABSTRACT

A novel apparatus for harvesting ice from an ice maker is disclosed. A refrigeration system having a hot gas bypass valve and a water cooled condenser is used to make ice. A programmable controller interrupts the water supply to the condenser, causing the condensing pressure to rise rapidly. This pressure increase is sensed by a pressure sensor, which then opens the hot-gas valve, sending hot gaseous refrigerant to the evaporator to harvest the ice.

6 Claims, 2 Drawing Sheets

REVERSE CYCLE TYPE REFRIGERATION SYSTEM WITH WATER COOLED CONDENSER AND ECONOMIZER FEATURE

BACKGROUND AND OBJECTS OF THE INVENTION

The present invention relates in general to reverse cycle type refrigeration systems, and more particularly to an economizer cycle piping and control arrangement for reverse cycle type refrigeration systems using a water cooled condenser.

In years past, most refrigeration systems were designed to operate at fixed standard design conditions year-round in the interest of standardizing on a fixed set of operating conditions so as to minimize the need for adjusting the settings on the various system components. For example, such designs based on fixed standard design conditions were intended to avoid having to adjust the settings on such components as the expansion valves, hand throttling valves, and the various other control and adjusting devices as well as fixed orifice devices so as to compensate for changes in pressure differentials that might exist if changes in condensing pressure would occur.

More recently, as the cost of electrical power has escalated in the amount of potential saving that could be realized by operating larger refrigeration systems at reduced condensing pressures when ambient conditions would allow it came to the attention of management, the "economizer cycle" for industrial refrigeration systems was developed and has become standard in the industry. The normal type of "economizer cycle" would not allow most reverse cycle type refrigeration systems to function satisfactorily, however, because of the wide range in condensing temperatures and pressures which are encountered as well as the great variation in heat available in the discharge gas over the range of operating conditions of the refrigeration system. Many intricate and complicated systems of controls have been designed in an attempt to solve these type problems for the various types of reverse cycle applications, but in most cases at least as many problems have been created as were solved by such designs.

The incorporation of an "economizer cycle" in an ice harvesting type of thermal storage refrigeration system is particularly desirable because ice harvesting type refrigeration system applications are particularly "cost-conscious" and must be justified in most cases by a relatively quick pay-back.

An object of the present invention, therefore, is the provision of a reverse cycle type refrigeration system having a water cooled condenser, wherein controls and piping are arranged to take advantage of increased capacity and efficiency available at lower ambient conditions during the normal ice making portion of the cycle of the system and having novel valve control means causing the unit to always have a constant, standard defrost cycle operated under constant preset conditions regardless of water tower temperatures to achieve economizer cycle operation when the unit is put into the harvest mode.

Another object of the present invention is the provision of a novel piping and control arrangement for reverse cycle type refrigeration systems as described in the immediately preceding paragraph, wherein cooling tower fans are set to operate at full capacity to deliver the coldest water possible down to a predetermined temperature whenever the tower pump runs and circulate a full flow of this cooling tower water through the condenser to operate at the lowest condensing pressure and highest efficiency and reduce power cost, during the ice making cycle, but which provides programed control to cause condensing pressure to increase quickly up to a predetermined trip point to put the unit into the harvesting mode assuring operation of the defrost cycle under constant pre-set conditions regardless of tower water temperatures.

Other objects, advantages and capabilities of the present invention will become apparent from the following detailed description, taken in conjunction with accompanying drawing illustrating a preferred embodiment of the invention.

DETAILED DESCRIPTION OF A PREFERRED EMBODIMENT

Figure 1:
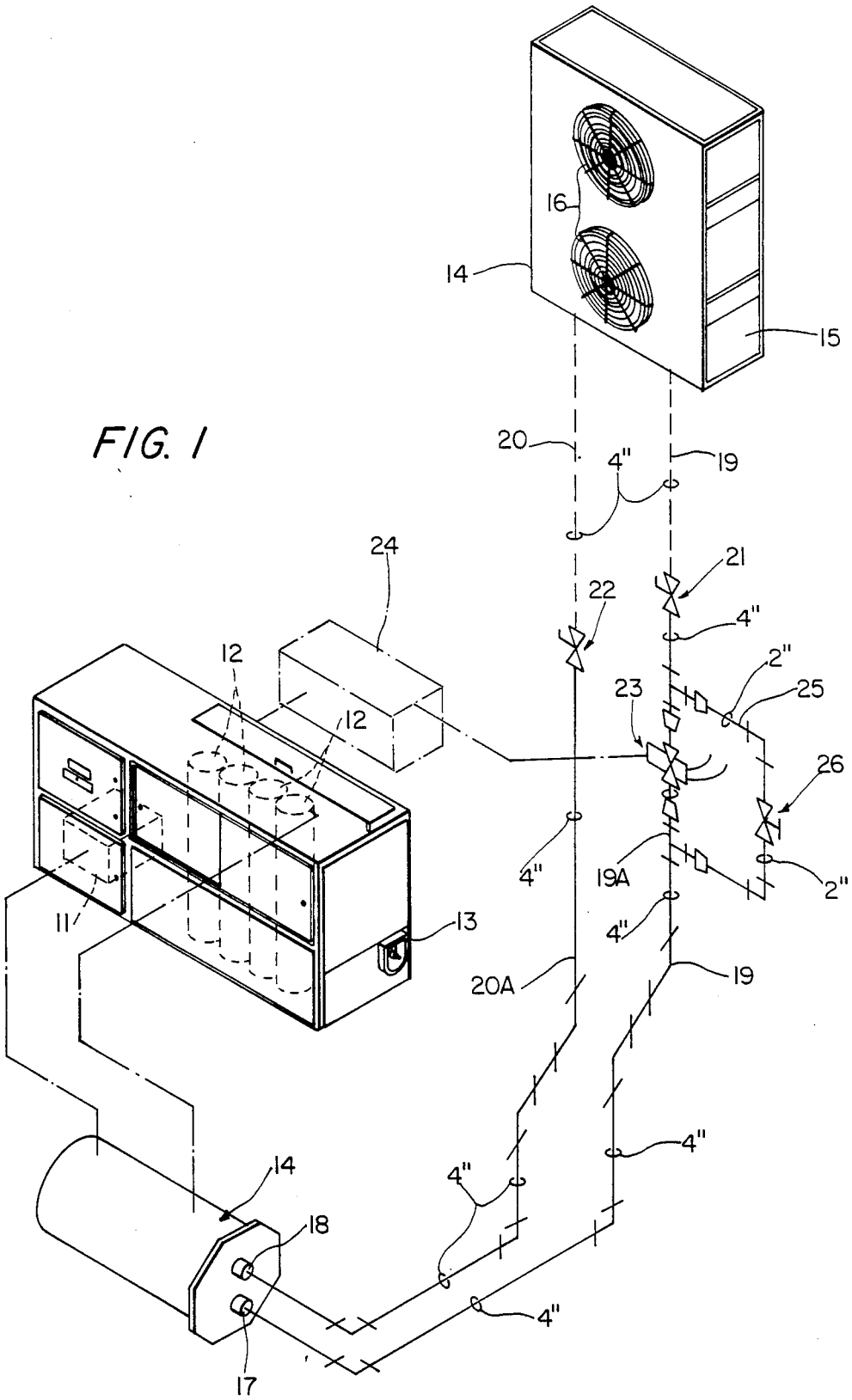
FIG. 1 is a schematic diagram of a cooling tower water piping system incorporating a main water solenoid control valve for the cooling water supply to the condenser and under control of a programmable controller, embodying one form of the present invention.

Referring to the drawings, where in like reference characters designate corresponding parts throughout the several figures, and particularly to FIG. 1, there is illustrated a schematic diagram of a cooling tower water piping system for a reverse cycle defrost ice maker refrigeration system embodying the present invention, such as the "Ice Master" Ice Maker produced by Morris & Associates of Raleigh, N.C., operating on a similar principle to the C. E. Lowe U.S. Pat. Nos. 3,820,585 or 3,026,686 or 3,034,310, in which the main ice maker unit has a generally rectangular housing enclosing a compressor, as diagrammatically illustrated at 11, and a plurality of ice maker evaporators, for example elongated tube evaporators, indicated diagrammatically at 12, which may be of the types disclosed in the above identified patents. The evaporator tubes during the freezing cycle form ice on the exterior surface thereof and, during the hot gas defrost cycle, for example, as described in the above identified earlier patents, the ice is gravitationally discharged into a trough and moved by a conveyor such as a screw conveyor, as illustrated at 13 in FIG. 1, to a discharge station. The refrigeration system also includes a water cooled condenser unit, indicated generally by the reference character 14, having the usual elongated cylindrical tank configuration with conduit connections to refrigerant line RC-1 for supplying hot gas refrigerant from the compressor 11 to the condenser 14 where the refrigerant is condensed to a liquid state by heat exchange with cooling water and the liquid refrigerant is supplied through refrigerant line. RC-2 to the inlet to the evaporators 12, as is well-known in the refrigeration art. The cooling water is conducted into heat exchange relation with the gaseous refrigerant supplied to the condenser 14 by the usual heat exchange or conducting coils in the interior of the condenser tank, the cooling water being supplied from a conventional water cooling tower indicated schematically at 15 associated with cooling tower fans 16, supplying the cooling tower water to the internal heat exchange water coils in the condenser through cooling water supply inlet 17 and returning through cooling water outlet 18 at one end of the condenser tank 14.

As shown in FIG. 1, the cooling water inlet conduit 19 from the cooling tower and the cooling water return conduit 20 returning water to the cooling tower 15 have water stop valves, for example 4-inch water valves, indicated at 21 and 22, the inlet or supply end of the stop valve 22 being connected directly by the water conduit, for example a 4-inch diameter piping conduit 20A, connected to the condenser outlet 18. The water supply or inlet leg having the stop valve 21 therein includes a valved main conduit section 19A which has a main water solenoid valve 23 therein electrically connected to a programmable controller indicated generally at 24, providing the primary valve means in the condenser water line for closing the condenser water line to cause the condensing pressure to increase quickly up to a predetermined "trip-point" pressure at the time of harvest to rapidly put the unit into the harvesting mode. An additional by-pass line of piping, for example of 2-inch conduit, is also provided, indicated by the reference character 25, having a ball valve 26 therein.

With such a system as schematically illustrated in FIG. 1, a harvest cycle sequence of operation can be achieved, wherein the programmable controller 24 at the time of harvest closes the main solenoid control valve 23 in the cooling tower water supply line 19, 19A to shut off cooling water supply to the inlet 17 of the water cooled condenser 14, which causes the condensing pressure to increase very rapidly up to the "trip-point," which may be typically 195 PSIG. This causes the compressor discharge pressure to rise rapidly due to reduced water flow through the condenser 14. The harvest pressure switch conventionally employed in such systems senses the pressure rise at the compressor discharge and trips the programmable controller 24 into the defrost cycle. This causes the usual hot gas by-pass valve (not shown) in the refrigerant line to open to begin the defrost cycle and the usual head pressure control valve opens. After thirty seconds, the programmable controller returns the ice harvester to the freeze cycle. The programmable controller is set to initiate this harvesting cycle every ten minutes.

Figure 2:
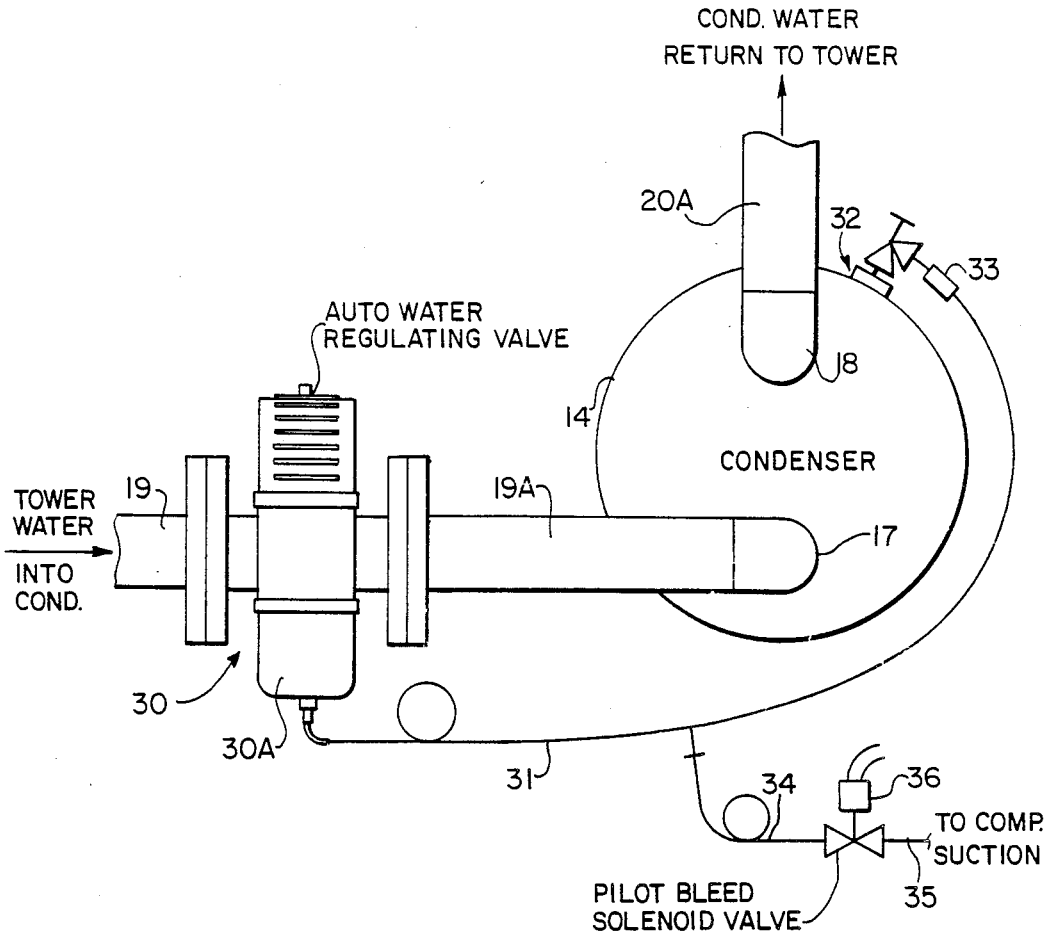
FIG. 2 is a somewhat diagrammatic illustration of the condensers showing the connecting portions of the tower water inlet conduit to the condenser and the tower water return conduit from the condenser, and an associated water pressure regulating valve and pilot bleed solenoid valve which may be substituted for the two position water solenoid valve of the FIG. (1) system.

An alternate version is shown somewhat schematically in FIG. 2, in which, instead of using the two position water solenoid valve 23, a conventional pressure actuated, water pressure regulating valve, indicated at 30 in FIG. 2, is employed in the tower water supply line or conduit 19 to the condenser inlet 17. This pressure actuated water regulating valve may be a conventional series V46 pressure actuated water regulating valve such as that manufactured and sold by the Control Products Division of Johnson Controls, Inc. The water regulating valve 30 is a direct acting valve of the kind typically used for regulating water cooled condensers, and is of the pressure-balanced type employing rubber sealing diaphragms to seal water away from a range spring incorporated in the upper portion of the valve assembly to seal water away from the range spring and guides and proportioned to the valve port area to balance the valve against both gradual and sudden water pressure changes. A pressure responsive bellows 30A in the lower portion of the valve assembly is connected by a pressure sensor feed line 31 connected as schematically indicated at 32 to the condenser 14 to sense the condensing pressure and having a small orifice as indicated at 33, for example a 1/64 inch orifice in the feed line 31 near the connection to the condenser. A bleed-off line or conduit 34 is connected to the pressure sensor feed line 31 between the orifice 33 and the inlet to the bellows portion 30A of the regulating valve 30 and is connected to the compressor suction line 35 through a small pilot solenoid valve 36. The pilot bleed solenoid valve 36 is opened at the beginning of the harvest cycle by the programmed controller, bleeding off the condensing pressure acting on the water regulating valve 30 through the feed line 31 to the bellows portion 30A of the water regulating valve 30 because of the connection through the bleed line 34 to the compressor suction. Since this reduces the gas pressure at the bellows portion 30A of the water regulating valve 30 to equal the suction pressure, the water pressure regulator valve 30 then closes fully and instantly the same as the main water solenoid valve 23 would. At such time as the reverse cycle or harvest portion of the cycle is completed, the pilot bleed solenoid valve 36 is closed allowing the gas pressure in the feed line 31 to build up on the bellows portion 30A of the water regulating valve to equal the condensing pressure and open the water regulating valve 30 again. Thus when the bleed solenoid 36 is closed, the condenser pressure controls the tower water regulating valve 30 to maintain constant condenser pressure at the minimum desired operating pressure for "economizer type operation."

I claim:

1. In a reverse cycle type defrost ice maker refrigeration system having a compressor, a condenser evaporator means, water tower means and a cooling water conduit system for flow of cooling water from the water tower through a water supply leg to the condenser for heat exchange cooling of refrigerant in the condenser and return of the water through a return leg to the tower, a refrigerant conduit system for conducting refrigeration from the compressor through heat exchange coil means in the condenser to be cooled by cooling water from the water tower means and for conveying condensed liquid refrigerant from the condenser to the evaporator means and returning gaseous refrigerant from the evaporator to the compressor, refrigerant valve means for bypassing the condenser and routing hot gaseous refrigerant to the evaporator and system cycle control means therefor for cycling the system through an ice making cycle and through a harvest defrost cycle; the improvement comprising a main water supply control valve means in said water supply leg of said cooling water conduit system interposed in said supply leg between the water tower means and a cooling water inlet of said condenser connected to said supply leg and valve control means for actuating the main water supply control valve to shut off cooling water supply to the condenser cooling water inlet immediately at the commencement of each harvest defrost cycle to cause condensing pressure to increase quickly up to a predetermined trip-point pressure whereupon harvest pressure switch means of the system cycle control means responds to pressure rise at the condenser discharge at the trip-point pressure to activate the refrigerant valve means to route hot gaseous refrigerant to the evaporator means for the duration of the harvest defrost cycle.

2. A reverse cycle type defrost refrigeration system as defined in claim 1, wherein said main water supply control valve means is a solenoid valve connected to said valve control means and providing primary valve means in the water supply leg of said cooling water conduit system for closing said water supply leg to cause the condenser pressure to rise rapidly when time for commencement of the harvest defrost cycle is signaled by the valve control means.

3. A reverse cycle type defrost refrigeration system as defined in claim 1, wherein said water supply leg of said cooling water conduit system includes a valved main conduit section having said main water supply control valve means therein and a by-pass conduit branch connected to the water supply leg above and below said control valve means, the by-pass conduit branch including a manually operable ball valve therein.

4. A reverse cycle type defrost refrigeration system as defined in claim 2, wherein said water supply leg of said cooling water conduit system includes a valved main conduit section having said solenoid valve therein and a by-pass conduit branch connected to the water supply leg upstream and downstream of said solenoid valve, the by-pass conduit branch including a manually operable ball valve therein.

5. A reverse cycle type defrost refrigeration system as defined in claim 1, wherein said main water supply control valve is a pressure actuated water regulating valve, a pressure sensing feed line connected to the water regulating valve and connected through a small orifice the condenser and connected between the orifice and the condenser to a bleed-off line having a pilot solenoid valve and connected to a suction leg of the refrigerant conduit system, and means connecting the pilot solenoid valve to the system cycle control means to activate the pilot solenoid valve to open condition when initiation of a harvest cycle is to occur to bleed off condensing pressure acting on the water regulating valve, thus reducing gas pressure which holds the water regulating valve open during the ice making cycle and allowing the water regulating valve to quickly close terminating cooling water supply to the condenser which produces rapid increase of the condenser pressure to said trip-point.

6. A reverse cycle type defrost refrigeration system as defined in claim 3, wherein said main water supply control valve is a pressure actuated water regulating valve, a pressure sensing feed line connected to the water regulating valve and connected through a small orifice the condenser and connected between the orifice and the condenser to a bleed-off line having a pilot solenoid valve and connected to a suction leg of the refrigerant conduit system, and means connecting the pilot solenoid valve to the system cycle control means to activate the pilot solenoid valve to open condition when initiation of a harvest cycle is to occur to bleed off condensing pressure acting on the water regulating valve, thus reducing gas pressure which holds the water regulating valve during the ice making cycle and allowing the water regulating valve to quickly close terminating cooling water supply to the condenser which produces rapid increase of the condenser pressure to said tip-point.

* * * * *